US005365318A

United States Patent [19]

Hiraoka et al.

[11] Patent Number: 5,365,318

[45] Date of Patent: Nov. 15, 1994

[54] DEVELOPER UNIT UTILIZING A NON-MAGNETIC SINGLE COMPONENT DEVELOPER

[75] Inventors: Yuji Hiraoka; Chiseki Yamaguchi, both of Saitama, Japan

[73] Assignee: Hiraoka H.I. Laboratory Co., Ltd., Saitama, Japan

[21] Appl. No.: 914,954

[22] Filed: Jul. 16, 1992

[30] Foreign Application Priority Data

Jul. 9, 1992 [JP] Japan ..... 4-220576

[51] Int. Cl.[5] ..... G03G 21/00

[52] U.S. Cl. ..... 355/246; 118/653; 355/208; 355/259

[58] Field of Search ..... 355/246, 208, 245, 253, 355/259, 261-265; 118/653, 651, 656, 647, 644, 708, 712

[56] References Cited

U.S. PATENT DOCUMENTS

| | | | |
|---|---|---|---|
| 4,521,103 | 6/1985 | Ohtsuka et al. | 118/647 X |
| 4,686,934 | 8/1987 | Kohyama | 118/656 X |
| 5,017,967 | 5/1991 | Koga | 355/253 X |
| 5,128,718 | 7/1992 | Mizoguchi | 355/208 |
| 5,170,213 | 12/1992 | Yamaguchi et al. | 355/246 |
| 5,179,414 | 1/1993 | Bhagat | 355/259 |
| 5,183,964 | 2/1993 | Stelter et al. | 355/259 X |

*Primary Examiner*—A. T. Grimley
*Assistant Examiner*—Shuk Y. Lee
*Attorney, Agent, or Firm*—Baker & Daniels

[57] ABSTRACT

Stable developing can be made with no inferior image, irrespective of variations in factors relating to the developing function, which affect the developing function, such as a variation in surrounding circumstance, surface potentials of an electrostatic latent image carrier medium and a developer carrier medium or the like. When surface potential sensors serving as a means for detecting a factor relating to the developing function detect variations in the surface potentials of latent image carrier medium or developer carrier medium, voltages applied from power sources, to conductivity regulating member, developer carrier medium and electrically conductive developer supply member are controlled so that the volume of the developer sticking to the electrostatic latent image carrier medium is maintained to be constant. The developer carrier medium transfers a thin layer of the developer to a developing section opposing a photosensitive body and the developer is shifted in an electric field between the surface potential of the electrostatic latent image section on the photosensitive body and the surface potential of the developer carrier medium so as to effect developing.

10 Claims, 5 Drawing Sheets

DEVELOPER UNIT UTILIZING A NON-MAGNETIC SINGLE COMPONENT DEVELOPER

BACKGROUND OF THE INVENTION

The present invention relates to a developing apparatus for developing an electrostatic latent image with the use of a developer, and in particular to a developing apparatus using a nonmagnetic one-component developer.

DESCRIPTION OF THE RELATED ART

Heretofore, in general, a developing method using a two-component developer composed of a toner and a carrier, such as a method of developing an electrostatic latent image that is formed on a uniformly charged photosensitive medium by exposure in accordance with an image information, in particular, a magnetic brush developing method (which will be hereinbelow simply denoted as "two component magnetic brush developing method"), has been frequently used. However, a two component magnetic brush developing method has practical problems such that a large size developing apparatus is required, the stabilization of mixture ratio of the toner and the carrier is difficult, the stabilization of charge of the toner by stirring is difficult, and so forth Further, recently, a magnetic brush developing method using a one component developer including a toner that itself has a magnetism, (which will be hereinbelow simply denoted as "one component magnetic brush developing method) has been practically used. However, although this one component magnetic brush developing method can realize the miniaturization of the developing apparatus, it raises an inherent problem of colorlization since the developer contains a magnetic powder. In view of the above-mentioned view points, methods of using a non-magnetic one component developer (which will be hereinbelow denoted as "a non-magnetic one component developing method) have been proposed, and various studies have been made therefore. Among these non-magnetic one component developing method, there are two different kinds of methods, one of which is made in a condition that a developer makes contact with an electrostatic latent image carrier medium (such as a photosensitive medium or the like), and the other one of which is made in a condition that a developer does not contact with an electrostatic latent image carrier, but it flies onto the electrostatic latent image carrier medium.

The former method of the developer contact type is excellent in view of improved image density and the supply of the developer, but there is a disadvantage that fogging is likely to occur since the developer makes contact with the electrostatic latent image carrier medium. Further, it cannot be used for such a transfer method wherein different colors are superposed on a single drum during one revolution thereof, which can simplify the arrangement of an entire developing apparatus in future colorlization, and which can reduce the cost thereof, since the contact between the developer and the electrostatic latent image carrier medium gives rise to a problem of color mixture.

In view of the above, the use of the latter non-magnetic one component developing method of the non-contact and flying type has been in demand.

In a conventional developing apparatus using the above-mentioned non-contact and flying type non-magnetic one component developing method, since a non-magnetic one component developer is used, there has been a problem of causing an inferior image such as a blurred image or the like if the removal, agitation and circulation of the developer cannot be stably made, in addition to the supply of the developer onto a developer carrier medium, the charge with electricity, the formation of a thin layer, the conveyance to a developing section and the control of flying.

For example, in a conventional developing apparatus as shown in FIG. 5, which carries out simultaneously the charge with electricity to a developer T and the formation of a thin layer, by a press contact blade 53, since the charged value of the developer T cannot be stabilized due to frictional charging, there have been a problem that the developing is greatly influenced by variations in the material quality, surface condition and the like of the press contact blade, and variations in the surrounding circumstance so that the developing becomes unreliable.

Also, since a residual of the developer T remaining unused for development of an electrostatic latent image on an electrostatic latent image carrier medium 52, is not removed from the developer carrier medium 51, and is then used again for the next developing after one revolution of the developer carrier medium 51, there have problems in the stabilization of the charged value of the developer T and in the ability of agitation of the developer T.

SUMMARY OF THE INVENTION

The present invention has been devised in view of the above-mentioned problems, and accordingly, one object of the present invention is to provide a developing apparatus which is provided therein with, in particular, a developer carrier medium for carrying a developer thereon, an electrically conductive developer supply member participating in the supply, removal and change of the developer, and an electrically conductivity regulating member participating in the stabilization of the charge to the developer, and in which the outputs of power sources connected respectively to the developer carrier medium, the conductive developer supply member and the conductivity regulating member are controlled so as to enable stable developing without causing an inferior image, while having the functions of supply and charge with electricity of the developer, formation of a thin layer, conveyance to the developing section, and control of flying force, and removal, agitation and circulation of the developer.

To the end, according to the present invention, there is provided a developing apparatus comprising a developer carrier medium for carrying a developer used to develop an electrostatic latent image formed on an electrostatic latent image carrier medium, an electrically conductive developer supply member rotatably arranged and made into contact with the developer carrier medium, a conductivity regulating member for forming a thin layer of the developer having a layer thickness to cover the developer carrier medium while regulating the layer thickness of the developer on said developer carrier medium, and for charging the developer up to a predetermined degree, power sources for applying voltages to the developer carrier medium, the electrically conductive developer supply member and the conductivity regulating member, and a control means for controlling the applied voltages in accordance with outputs from means for detecting factors relating to developing characteristics of the apparatus.

In view of the foregoing, in the developing apparatus according to the present invention, the electrically conductive developer supply member applied with a voltage supplies the developer onto the developer carrier medium while charges the developer, and the conductivity regulating member applied with a voltage forms a thin layer of the developer over the developer carrier medium while regulates the layer thickness of the developer onto the developer carrier medium, and charge the developer up to a predetermined degree. Further, the developer carrier medium applied with a voltage conveys the thin layer of the developer to a developing section opposing the electrostatic latent image carrier medium so as to transfer the developer for developing in an electric field between a potential of an electrostatic latent image section on the electrostatic latent image carrier medium and a surface potential of the developer carrier medium, and the electrically conductive developer supply member scrapes off a part of the developer remaining on the developer carrier medium after developing The factor detecting means detects a variation in the surrounding circumstance, a variation in charge function of the developer in association with the afore-mentioned variation, a variation in developing function in association with a variation or the like in characteristic of the electrostatic latent image carrier medium, and the outputs of the power sources are controlled in accordance with an output from the detecting means so as to maintain a uniform volume of the developer sticking to the electrostatic latent image carrier medium. Incidentally various factors such as the above-mentioned surrounding circumstance, the density of the developer on the electrostatic latent image carrier medium, the surface potentials of the electrostatic latent image carrier medium and the developer carrier medium and the like are called in the factors participating in the developing functions of the apparatus, according to the present invention.

DESCRIPTION OF THE PREFERRED EMBODIMENTS

Explanation will be made of the present invention in detail with reference to the drawings:

[First Embodiment]

Figure 1:
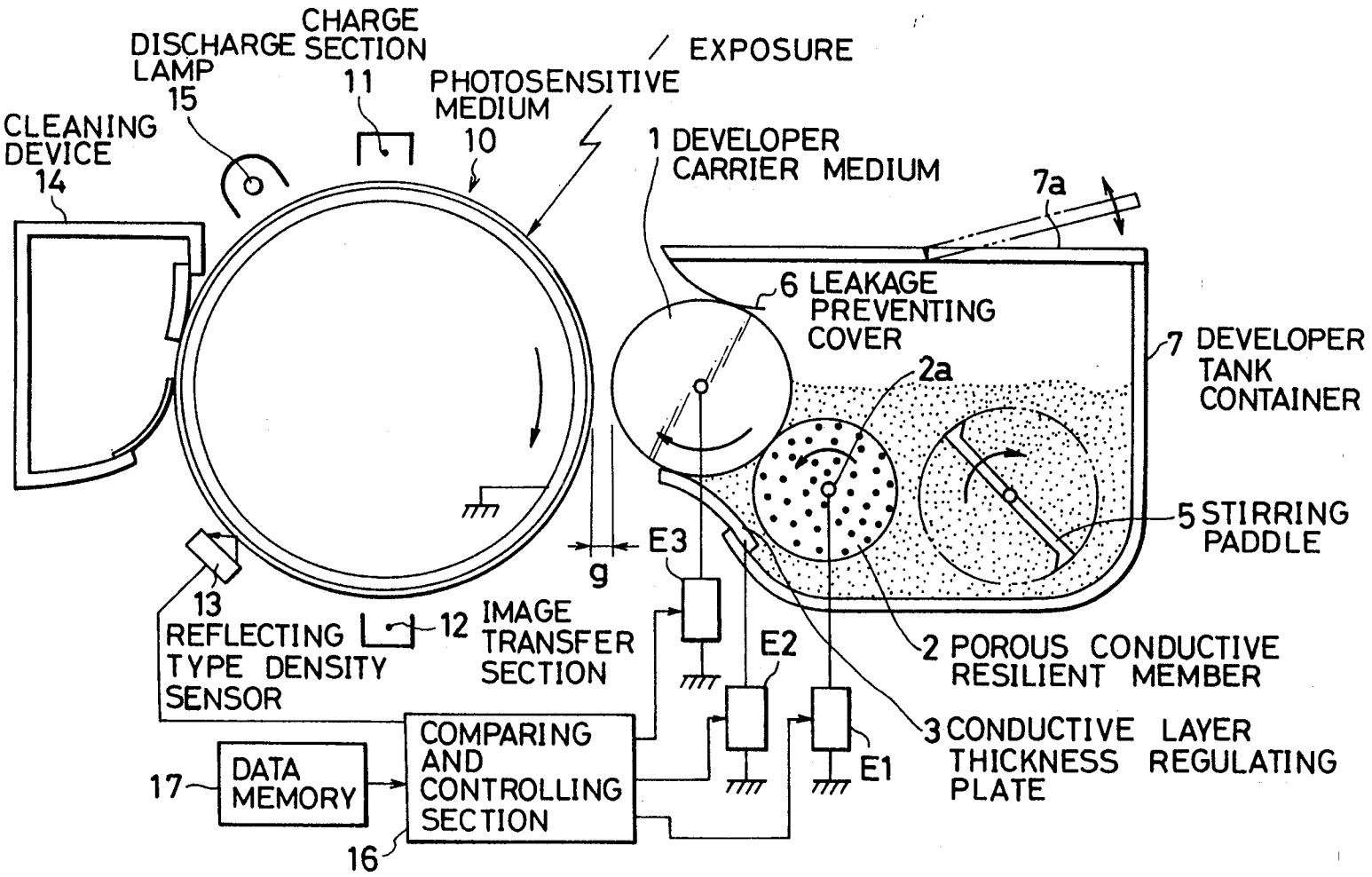
FIG. 1 is a block diagram showing an image recording apparatus in which a developing apparatus in a first embodiment of the present invention is incorporated.

FIG. 1 is a block diagram showing an image recording apparatus in which a developing apparatus in a first embodiment of the present invention is incorporated. The essential part of the developing apparatus in the first embodiment comprises a developer carrier medium 1 composed of a metal roller opposed to a photosensitive medium (electrostatic latent image carrier medium) 10 on which an electrostatic latent image is formed, with a gap g therebetween and rotatably supported, a roller-like porous conductive resilient member (electrically conductive developer supply member) 2 which is in part made to contact with the developer carrier medium 1 and which is rotatably supported, an electrically conductive layer thickness regulating plate (conductivity regulating member) 3 for regulating the layer thickness of a nonmagnetic one component developer T (which will be hereinbelow denoted simply as "developer") so as to form a thin layer of the developer T over the developer carrier medium 1, and for charging the developer T up to a predetermined degree, a stirring paddle 5 for stirring the developer T in a developer supply section, a leakage preventing cover 6 for preventing the developer T from leaking from the upper part of the developer carrier medium 1, a developing tank container 7 to which the above-mentioned members are attached and which constitutes the developer supply section for storing the developer T, a power source E1 connected the porous conductive resilient member 2, a power source E2 connected to the conductive layer thickness regulating plate 3 and a power source E3 connected to the developer carrier medium 1.

The porous conductive resilient member 2 is made of soft foamed polyurethane materials or the like containing conductive carbon and having a three-dimensional system structure, and is formed in a roll-like shape on a metal shaft **2*a* which is rotatably supported on the wall of the developer tank container 7. The porous conductive resilient member 2 is bonded to the metal shaft 2*a* with conductive glue such as epoxy group adhesive containing a silver (Ag) filler, acrylic group glue containing a carbon filler or the like. The porous conductive resilient member 2 has a specific resistance of about $10^3$ to $10^{10}$ Ωcm. Accordingly no leak occurs between the power source E1 connected to the porous conductive resilient member 2 and the power source E3 connected to the developer carrier medium 1 so that the porous conductive resilient member 2 and the developer carrier medium 1 can maintain high potentials, respectively. Incidentally, the polarity of the power source E1** is the same as the charged polarity of the developer T.

Also, the level of porosity of the porous conductive resilient member 2 is preferably be such that the number of cells (holes) is more than 15 but less than 45 per 25 mm. Further more, the contact depth (wedge-in depth) of about 0.5 to 1.0 mm the porous conductive resilient member 2 to the developer carrier medium 1 was empirically satisfactory in view of the transferability of the developer T and the removal effect of the developer T remaining on the developer carrier medium 1 after developing.

The conductive layer regulating plate 3 is formed of a silicone rubber plate which is made to be conductive by dispersing or sticking an electrically conductive material (for example, electrically conductive carbon) thereto, or the like, having a hardness of about 60° to 80° and a thickness of about 2 to 3 mm. The conductive layer thickness regulating plate 3 touches the developer carrier medium 1 with the flank and/or edge parts of the silicone rubber plate or the like, so as to regulate the layer thickness of the developer T in order to form a thin layer of the developer T having a thickness of about 20 to 40 μm over the developer carrier medium 1 although it is regulated by a contact pressure, and to charge the developer T up to a predetermined degree.

The conductive layer thickness regulating plate 3 has a specific resistance set to about $10^3$ to $10^{10}$ μcm. Accordingly, no leak occurs between the power source E2 connected to the conductive layer thickness regulating plate 3 and the power source E3 connected to the developer carrier medium 1, and further, the conductive layer thickness regulating plate 3 and the developer carrier medium 1 can maintain high potentials, respectively. Incidentally, the polarity of the conductive layer thickness regulating plate 3 is the same as the charged polarity of the developer T.

Further, although in this embodiment, an example of constituting the conductive layer thickness regulating plate with the same material, the conductive layer thickness regulating plate 3 should not be limited to such that it is formed of one and the same material as stated in this embodiment, but the function for the conductive layer thickness regulating plate 3 can be also satisfied by those which can be applied, in them neighborhood around a surface adapted to abutting against the developer carrier member 1, with a voltage, and which have a predetermined specific resistance and can satisfy the mechanical abutting conditions to the developer carrier medium 1 by a member supporting thereof.

The stirring paddle 5, is not limited, in its shape, however, it preferably has a shape which is effective for the agitation and circulation of the developer T in the developer supply section in the developing tank container 7, and which does not createportions of stagnation or agglomeration in the developer T.

The leakage preventing cover 6 is suitably formed of a urethane rubber plate having a thickness of about 0.02 mm or the like.

The power sources E1, E2, E3 are constant voltage power sources which change their output voltages in accordance with an output from a comparing and controlling section 16, and are adapted to apply voltages to the porous conductive resilient member 2, the conductive layer thickness regulating plate 3 and the developer carrier medium 1, respectively.

Even through the outputs of the power sources E1, E2, E3 are controlled to constant voltages, the developing function of the developing apparatus varies in accordance with a variation in the charge function of the developer T in association with a variation in the surrounding circumstance, a variation in flying force of the developer T between the photosensitive medium 10 and the developer carrier 1 in association with a variation in the surrounding circumstance and the like. Further, it also varies in accordance with a change of state caused by use or non-use of components constituting the developing apparatus for a long time.

Next, explanation will be made of the operation of the developing apparatus in the first embodiment together with the operation of the image recording apparatus.

When the operation of the image recording apparatus is started, an image density setting process is initiated prior to an actual image forming process, and the developer carrier medium 1, the porous conductive resilient member 2, the stirring paddle 5 and the photosensitive medium 10 start rotation in their respective directions as indicated by the arrows.

At this time, the power sources E1, E2, E3 are controlled by an output from the comparing and controlling section 16 and therefore, their outputs are set to their respective initial set output voltages. For example, the power source E1 is set to 600 V, the power sources E2 to 400 and the power source E3 to 300 V. These initial set output voltage are values which are set as output voltages of the power sources E1, E2, E3 for shifting the developer T onto the photosensitive medium 10 so as to have a specified image density during the developer T newly supplied is used in a room temperature condition.

Figure 2:
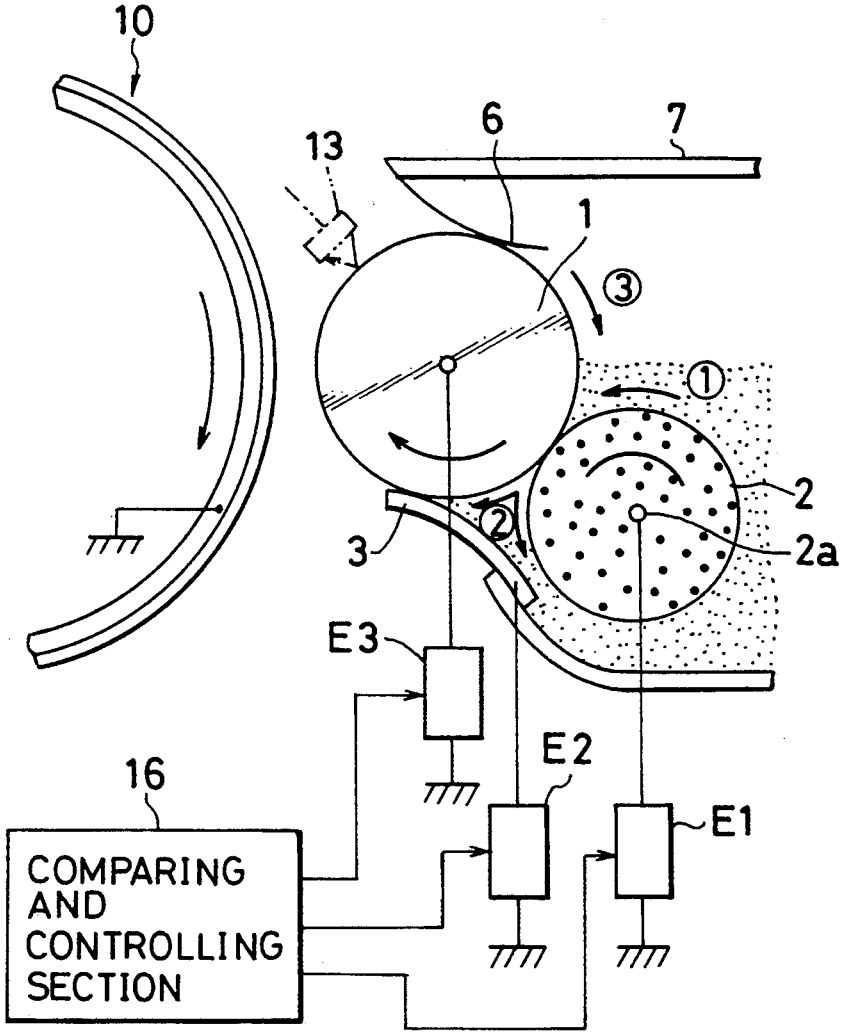
FIG. 2 is an enlarged view illustrating an essential part of the developing apparatus in the first embodiment shown in FIG. 1, indicating the flow of a developer.

When the rotation of the developer carrier medium 1, the porous conductive resilient member 2 and the stirring paddle 5 is started, the developer T stored in the developer supply section in the developing tank container 7 is conveyed to a contact area between the porous conductive resilient member 2 and the developer carrier medium 1 due to the rotation of the porous conductive resilient member 2, as shown by (1) in FIG. 2, and is charged by the porous conductive resilient member 2 which is connected to the power source E1.

The developer T charged by the porous conductive resilient member 2 is moved in association with the rotation of the developer carrier medium 1 and the porous conductive resilient member 2, as shown by (2) in FIG. 2, and a part of the developer T is regulated to a thickness of about 20 to 40 μm by the conductive layer thickness regulating plate, and is formed into a thin layer over the developer carrier medium 1, and is controlled to a stable predetermined degree of charge by an electric charge applied from the conductive layer thickness regulating plate 3 which is applied with a voltage from the power source E2. At this time, the sticking force between the developer carrier medium 1 and the developer T is a mirror image force between an electric charge owned by the developer T and the developer carrier medium 1 made of metal.

The thin layer of the developer T formed over the developer carrier medium 1 is conveyed in association with the rotation of the developer carrier medium 1 to the developing section which is opposed to the photosensitive medium 10 formed thereon with a electrostatic latent image with a distance (the gap g—the thickness of the thin layer of the developer T) .

Since the developer carrier medium 10 has been applied thereto with a voltage from the power source E3, and since the surface charge density of an image part of the electrostatic latent image on the photosensitive member 10 is different from that of a non-image part thereof, the force $F=qE$ given to the developer T, (where q is a degree of charge to the developer T and E is an electric field at the position of the developing section), is different between the image part and the non-image part of the electrostatic latent image, and accordingly, the developer T only within the image part flies from the developer carrier medium 1 onto the photosensitive medium 10.

A part of the developer T on the developer carrier medium 1 which is not used, is conveyed toward the leakage preventing cover 6 in association with the rotation of the developer carrier medium 1 so as to be restored into the developer supply section in the developing tank container 7. The leakage preventing cover 6 makes contact with the developer carrier medium 1 with a soft touch although it abuts against the same with a curved part thereof, accordingly, the developer T is led into the developing tank container 7 without being peeled off the developer carrier medium 1 by the leakage preventing cover 6.

The developer T remaining on the developer carrier medium 1, which has been led into the developing tank container 7, is conveyed toward the porous conductive resilient member 2, as indicated by (3) in FIG. 2, and is scraped off from the developer carrier medium 1 by the porous conductive resilient member 3, and is then conveyed toward the stirring paddle 5 in the developing tank container 7 in association with the rotation of the porous conductive resilient member 2, as indicated by (2) in FIG. 2. Then, the developer T is circulated in the developing tank container 7 for agitation in order to be reused for developing.

Although as a developer T, a residual developer T and an unused developer are remaining mixed in the developer supply section in the developing tank container 7, all of the developer T stuck to the photosensitive medium 10 so as to be used as a developer 7 is subjected to the contact with and conveyance by the porous conductive resilient member 2 and the electrically conductive layer thickness regulating plate 3, therefore, the degree of charge is controlled by application of an electric charge in the developer supply section.

If the developer supply section in the developing tank container 7 is replenished with the developer T as the developer T is consumed, it can be made by opening a supply lid 7*a*, or by use of a cartridge.

Incidentally, it is effective to set the peripheral speed of the developer carrier medium 1 to a value which is higher than the peripheral speed of the photosensitive medium 10 in order to ensure the image density. Further, setting the peripheral speed of the porous conductive resilient member 2 to be higher than that of the developer carrier medium 1 not only enhances the effect of scraping off the developer T remaining on the developer carrier medium 1 but also is effective for the supply of the developer T onto the developer carrier medium 1 and the charge to the same by the porous conductive resilient member 2 in the next developing process.

Meanwhile, the photosensitive medium 10 arranged being opposed to the developing apparatus, is uniformly charged by a charge section 11 when it starts rotation in association with a start of the image recording apparatus, and is then exposed to a light beam having a reference exposure energy from the exposure section, over a specified area such as about 5 cm×5 cm, and accordingly, the reference electrostatic latent image is created in order to check the developing function of the developing apparatus, prior to actual formation of an electrostatic latent image on the photosensitive medium 10 in accordance with image data.

The reference electrostatic latent image formed on the photosensitive medium 10 is developed by the developing apparatus in which the output voltages of the power sources E1, E2, E3 are set to the above-mentioned initially set output voltages. After the developing of the reference electrostatic latent image, when a reference developed image which has been obtained by developing the reference electrostatic latent image, comes to a position opposing a reflecting type density sensor 13 in association with the rotation of the photosensitive medium 10, the reflecting type density sensor measures an optical reflectivity of the reference developed image, and delivers an output to the comparing and controlling section 16.

The data memory 17 stores therein first reference data corresponding to the optical reflectivity of the reference developed image on the photosensitive medium 10, which is obtained when it has a specified image density, and the comparing and controlling section 16 reads the first reference data from the reference data memory 17 and compares the same with the output from the reflecting type density sensor 13.

If the output from the reflecting type density sensor 13 is higher than the first reference data, that is, if the optical reflectivity of the reference developed image on the photosensitive medium 10 which has been obtained by developing with the initially set output voltages, is higher than the optical reflectivity of the developer T on the photosensitive medium 10 which has a reference image density, it exhibits an insufficient image density, and accordingly, the comparing and controlling section 16 determines that the developing function of the developing apparatus has to be enhanced. Thus, the comparing and controlling section 16 controls the power sources so that, for example, the output voltage of the power source E1 is increased while the output voltage of the power source E2 is decreased. According to experiments, if the output voltage of the power sources E1 is set to 600 V, that of the power source E2 to 400 V and that of the power source E3 to 500 the developing function of the developing apparatus can be enhanced by increasing the output voltage of, for example, the power source E3 from 600 V to 650 V, or by decreasing the output voltage of the power source E2 from 400 V to 350 V.

Further, the enhancement of the developing function caused by increasing the output voltage of the power source E1 is caused by an increase in the supply volume of the developer T onto the developer carrier medium 1, which is effected by an increase in the electric field between the porous conductive resilient member 2 and the developer carrier medium. Also, the enhancement of the developing function caused by decreasing the output voltage of the power source E2 is caused by an increase in the volume of the developer T to be conveyed to the developing area, which is effected by reducing the capability of electrostatically limiting the layer thickness of the developer T on the developer carrier medium 1 within mechanically and electrostatically being limited by the electrically conductive layer thickness regulating plate 3.

The capability of electrostatically regulating the layer thickness is caused by a variation in the stacking volume of the developer T onto the developer carrier medium due to a variation in the electric field since the electric field is created between the developer carrier medium 1 and the conductive layer thickness regulating plate 3 for the developer T passing therebetween, and if the voltage of the developer carrier medium 1 becomes relatively higher than that of the conductive layer thickness regulating plate 3, a large volume of the developer T sticks to the developer carrier medium 1.

Incidentally, as a general method of changing the developing function, a method of changing the output voltage of the power source E3 connected to the developer carrier medium 1 can be used. However, in this method, the image density is likely to vary as the output voltage is slightly changed, and since the developing bias is simply changed, blurring would occurs if the output voltage is changed so as to enhance the image density. Accordingly, sufficient control is difficult only by changing the output voltage of the power source E3.

Next, if the output from the reflecting type density sensor 13 is equal to or lower than the first reference data, that is, if it is determined that the developing function is satisfactory, the measurement is made not only for the optical reflectivity of the reference developed image on the photosensitive medium 10 but also for the optical reflectivity of a non-developed part on the photosensitive medium 10. At this time, since to developer T must be present in the non-developed part on the photosensitive medium 10, the optical reflectivity of the photosensitive medium 10 itself should be measured. Data corresponding to the optical reflectivity of the photosensitive medium 10 is stored as a second reference data in the data memory 17, which is compared with the output from the reflecting type density sensor 13 upon measurement of the optical reflectivity of the non-developed part.

Upon measurement of the optical reflectivity of non-developed part on the photosensitive medium 10, if the output from the reflecting type density sensor 13 is lower than the second reference data, it indicates occurrence of blurring, and accordingly, it is required to control the developing apparatus so as to lower the developing function. In this case, the power sources E1, E2, E3 are controlled in accordance with an output from the comparing and controlling section 16 so as to lower the developing function. For example, it is considered that the output voltage of the power source E1 is decreased, and the output voltage of the power source E2 is increased. Although the output voltage of the power source E3 may be decreased, the image greatly varies even with a slight variation, similar to the condition of enhancing the developing function as mentioned above, and further, because it would cause the density of full black to be lowered, this control is not preferable.

Further, not only one of the output voltage of the power sources E1, E2, E3 can be controlled as a result of the comparison, but also two or three thereof can be controlled in combination.

Thus, by controlling the outputs of the power sources E1, E2, E3, it is possible to prevent occurrence of insufficient image density and blurring, and accordingly, the stability of image reproduction can be secured.

The reference developed image is removed by a cleaning device 14 after completion of the measurement of the optical reflectivity by the reflecting type density sensor 13, and a residual charge on the photosensitive medium is removed by a discharge lamp 15. Thus, the image density setting process is completed.

After completing the image density setting process, the image recording apparatus starts the operation of an actual image forming process, and accordingly, the surface of the photosensitive medium 10 is uniformly charged by the charge section 11 in accordance with its rotation. The uniformly charged photosensitive medium 10 is selectively exposed by a light beam from the exposure section in accordance with an image data so as to form an electrostatic latent image on the surface thereof.

The electrostatic latent image formed on the photosensitive medium 10 is made to be visible as a developed image by the developing apparatus whose developing function has to be controlled suitably in the image density setting process.

When the developed image on the photosensitive medium 10 which has been developed by the developing apparatus comes to a position opposing an image transfer section 12, a recording medium which is not shown is fed between the photosensitive medium 10 and the image transfer section 12, and the developed image is transferred onto the front surface of the recording medium by an electric charge or the like which is applied to the rear surface of the recording medium by the image transfer section 12. Thereafter, the recording medium onto which the developed image has been transferred, is fixed in a developed image by a fixing section (which is not shown).

Meanwhile, a part of the developer T which remains on the photosensitive medium 10 without being transferred, is removed by the cleaning device 12, and a residual charge the photosensitive medium 10 is removed by the discharge lamp 15 for the preparation of the next image forming process.

Inidenally, the control of the outputs of the power sources E1, E2, E3 in accordance with a variation in the optical reflectivity of the reference developed image on the photosensitive medium 10 may be made not only prior to the image forming process based upon the image data, but also during the image forming process, that is, in the interspace between recording mediums.

By the way, in FIG. 1, the reflecting type density sensor 13 is arranged in the rear of the image transfer section 12 as viewed in the rotating direction of the photosensitive medium 10, but the reflecting type density sensor 13 can be located at any position between the developing apparatus and the cleaning device 14. Further, as indicated by the broken line in FIG. 2, the reflecting type density sensor can be arranged being opposed to the developer carrier medium 1 so that it does not measure the optical reflectivity of the developed image on the photosensitive medium 10 but measures the optical reflectivity of the thin layer of the developer T formed on the developer carrier medium 1.

Further, although d.c. power sources are shown as the power sources E1, E2, d.c. and a.c. composite power sources can be effectively used in order to prevent agglomeration of the developer T and to improve the conveying ability thereof. However, it is required to have a d.c. component which prevents the polarity of the developer T from being changed even though a.c. component is superposed.

Further more, output currents from the power sources E1, E2, E3 may be inputted as an input data to the comparing and controlling section 16 so as to detect an empty condition of the developer which is indicated by an abnormal current value, and accordingly, these output currents can be used as data for stopping the operation of the image recording apparatus, data for indication of replenishment of the developer, and the like.

[Second Embodiment]

Figure 3:
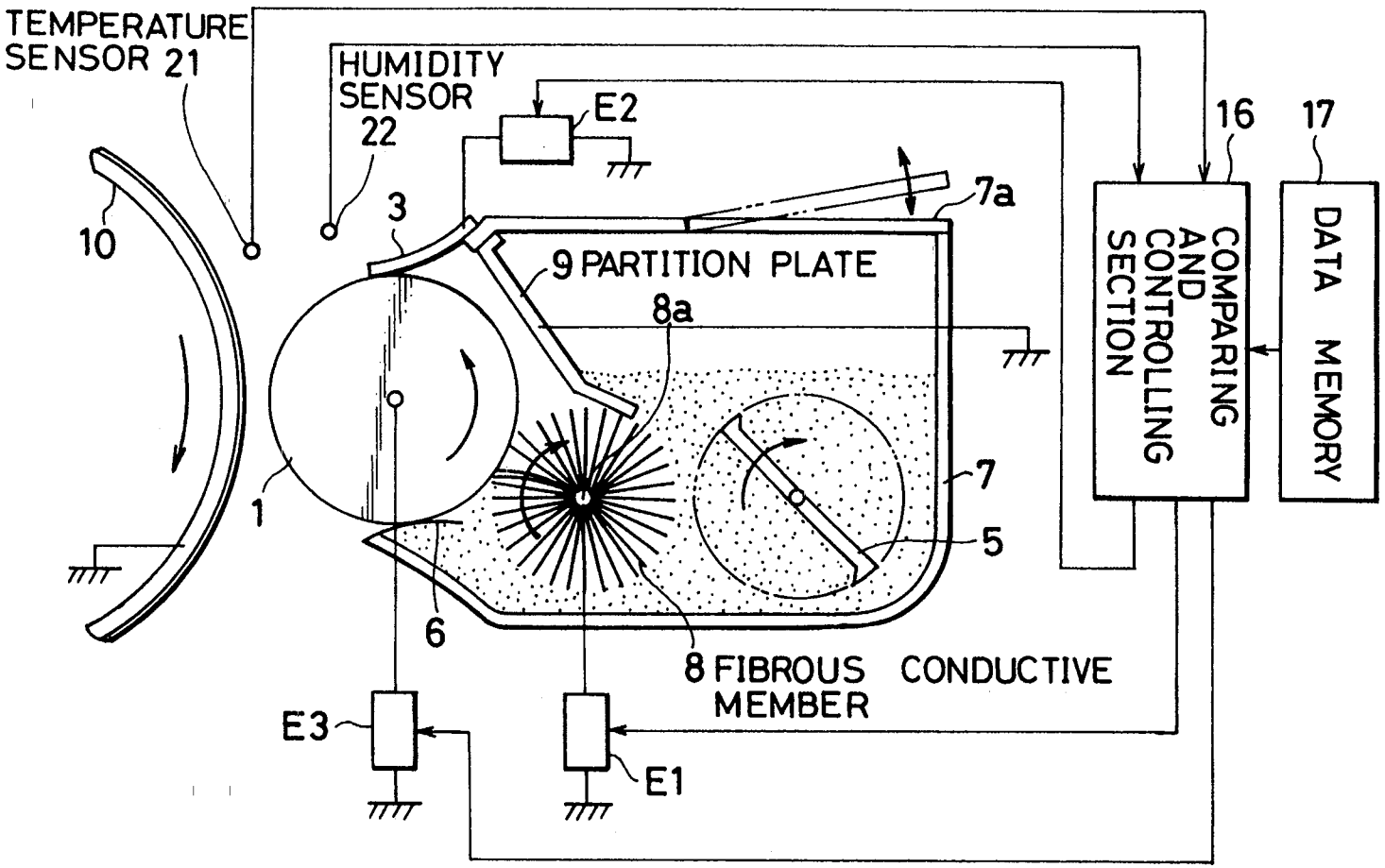
FIG. 3 is a block diagram showing a developing apparatus in a second embodiment of the present invention.

FIG. 3 is a block diagram illustrating a developing apparatus in a second embodiment of the present invention. In the developing apparatus in this embodiment, a fibrous conductive member 8 is used as the electrically conductive developer supply member, instead of the porous conductive resilient member 2 used in the developing apparatus in the first embodiment shown in FIG. 1.

The fibrous conductive member 8 is formed in a brush-like shape from conductive resin fibers made of for example, nylon, rayon or the like dispersed with conductive carbon, conductive resin fibers made of nylon, rayon or the like having a conductive material layer at the center thereof. As to how to make the fibers conductive, it may be made to be conductive by a post-process in which conductive carbon is formed into micro-particles which are then stuck to the outer surfaces of the fibers, and so forth. The conductive resin fibers has 100 to 2000 deniers/100 fibers, that is, the thickness of a fiber is set to 1 denier when 1 gram of the material is elongated up to 9000 m so as to be 1 to 20 deniers/1 fiber (100 to 2000 denier/100 fibers), and further, it is considered that a density of (10 to 100)$\times 10^3$ fibers per one square inch is suitable.

The fibrous conductive member 8 is formed in a brush-like shape on a metal shaft 8*a* rotatably supported to the wall of the developing tank container 7, similar to the porous conductive resilient member 2. The gluing of the fibrous conductive member 8 to the metal shaft 8*a* is made by using a conductive glue such as epoxy group glue containing a silver (Ag) filler, an acrylic group glue containing a carbon filler.

The depth of contact of the fibrous conductive member 8 with respect to the developer carrier medium 1 is set in a range from about 0.5 to 2.0 mm so as to achieve a desired function.

The rotational speed of the fibrous conductive member 8 is preferably set so that the peripheral speed thereof is equal to or higher than that of the developer carrier medium 1, which is similar to the porous conductive resilient member 2, although it differs depending upon the diameter thereof.

Further, in the developing apparatus in the second embodiment, the conductive layer thickness regulating plate 3 is laid on the upper part side of the developer carrier medium 1 and the leakage preventing cover 6 is laid on the lower part side thereof, which differs from the arrangement of the developing apparatus in the first embodiment.

Also, a partition plate 9 is arranged in the upper part of the fibrous conductive member 8 within the developing tank container 7. This partition plate 9 has such a shape that it prevents the developer T in the vicinity of the stirring paddle 5 from being directly fed to the developer carrier medium 1 without being transferred by way of the fibrous conductive member 8, and at the same time, it leads the developer T which is inhibited from being conveyed to the developing section upon formation of a thin layer by the conductive layer thickness regulating plate 3, or the developer T which remains after developing, recollected into the developing tank container 7 in association with the rotation of the developer carrier medium 1 and scraped off by the fibrous conductive member 8, into an area around the stirring paddle 5 within the developing tank container 7.

The partition plate 9 may be made of resin or the like, but it is preferably made of metal materials in view of the charged electrical charge to the developer T and the charge ability of the developer after charging, and is preferably grounded.

Even though the partition plate 9 makes contact with the fibrous conductive member 8, no voltage leakage from the power source E1 occurs thereby since the fibrous conductive member 8 has a specific resistance of about $10^3$ to $10^{10}$ $\mu$cm.

Further, in the vicinity of the developing apparatus in the second embodiment, a temperature sensor 21 for measuring temperature and a humidity sensor 23 for measuring humidity as data of surrounding circumstance are arranged, and their output terminals are connected to input terminals of comparing and controlling section 16, respectively. The comparing and controlling section 16 reads control data from the data memory 7 in accordance with outputs from the temperature sensor 21 and the humidity sensor 22, and controls the output voltages of the power sources E1, E2, E3 in accordance with the control data.

A thermistor or thermocouple or the like, formed by sintering metal oxide powder such as Mo, Ni, Co or the like can be used as the temperature sensor 21.

The humidity sensor 22 is made of lithium chloride, a carbon film, alumite or the like, which is adapted to measure a decrease in electrical resistance, caused by adsorption of moisture into the material of the sensor part.

Further, in the developing apparatus in the second embodiment, a constant voltage power source may be used as the power source E3, and constant current power sources may be used as the power sources E1, E2. If the constant current power sources are used as the power sources E1, E2, it is possible to realize further the stabilizing of charging electric charge to the developer T by controlling the output currents since the electric charge is applied to a part which makes contact with the developer T when the electric charge for charging the developer T is considered. The output currents may be controlled in a range of 5 to 200 $\mu$A.

Incidentally, the members not specifically mentioned in this embodiment, are constituted, similar to those in the developing apparatus in the first embodiment shown in FIG. 1, and accordingly, identical reference numerals are attached to the members corresponding to those in the first embodiment so that specific explanation thereto is omitted.

In the thus arranged developing apparatus in the second embodiment, an image density setting process is carried out prior to an image formation process, at the time of starting the operation of the image recording apparatus. In more detail, the comparing and controlling section 16 receives outputs from the temperature sensor 21 and the humidity sensor 22, that is, data of using circumstance prior to image forming process base on image data, and reads previously stored control data for the power sources E1, E2, E3 from the data memory 17 in accordance with the outputs so as to control the output currents of the power sources E1, E2 and the output voltage of the power source E3 to specified values in order to stably develop an image, irrespective of variations in the surrounding circumstance.

The control of the power sources E1, E2, E3 in accordance with variations in temperature and humidity is made in such a way that one or both of the output currents of the power sources E1, E2 are increased, for example, at high temperature and high humidity, but one or both of the output currents of the power sources E1, E2 are decreased at low temperature and low humidity. It is also possible to control variation in the output voltage of the power source E3, but it is not preferable to control only variation in the output voltage of the power source E3 due to the same reason as that of the developing apparatus in the first embodiment. However, the control of the outputs of the power sources E1, E2, E3 combined can secure a stable developing function.

Further, the control of the outputs of the power sources E1, E2, E3 in accordance with variations in temperature and humidity may be made not only before but also during the image forming process, that is, in the interspace between recording mediums, similar to the developing apparatus in the first embodiment shown in FIG. 1.

Although in the second embodiment the temperature sensor 21 is provided in the vicinity of the developing apparatus so as to measure the temperature therearound, it may be provided being in contact with the base member of the photosensitive medium 10 or an attached metal member or the like so as to measure the temperature of the photosensitive medium 10. In this case, it is possible to rapidly cope with a variation in the temperature characteristic of the charge function or sensitivity of the photosensitive medium 10.

Also in the developing apparatus in the second embodiment, the porous conductive resilient member 2 can be used, instead of a fibrous conductive member 8, similar to the developing apparatus in the first embodiment shown in FIG. 1. Furthermore, the direction of the rotation of the fibrous conductive member 8 is only one of examples, and the rotation can be reversed. In this case, it is also preferable to use a partition plate 9.

Further, a developer carrier medium having its outer surface provided with a semiconductor layer can be use as the developer carrier medium 1 in order to maintain a satisfactory developing function in a range from a half tone image to a full black tone image. The semiconductor layer is suitably formed by applying a resin material dispersed therein with conductive powder, having a specific resistance of $10^4$ to $10^{12}$ Ωcm so as to form a layer thereof having a thickness of 0.5 to 5 mm.

It has been explained that constant current power sources are used as the power sources E1, E2 while a constant voltage power source is used as the power source E3 in the developing apparatus in the second embodiment, with their outputs controlled. In this arrangement, the output currents from the power sources E1, E2 and the output voltage from the power source E3 are inputted as input data to the comparing and controlling section 16 so as to detect an empty condition of the developer when an abnormal voltage value or current value is detected, and the detected values can be used as data for stopping the operation of the image recording apparatus, data of indicating developer replenishment.

[Third Embodiment]

Figure 4:
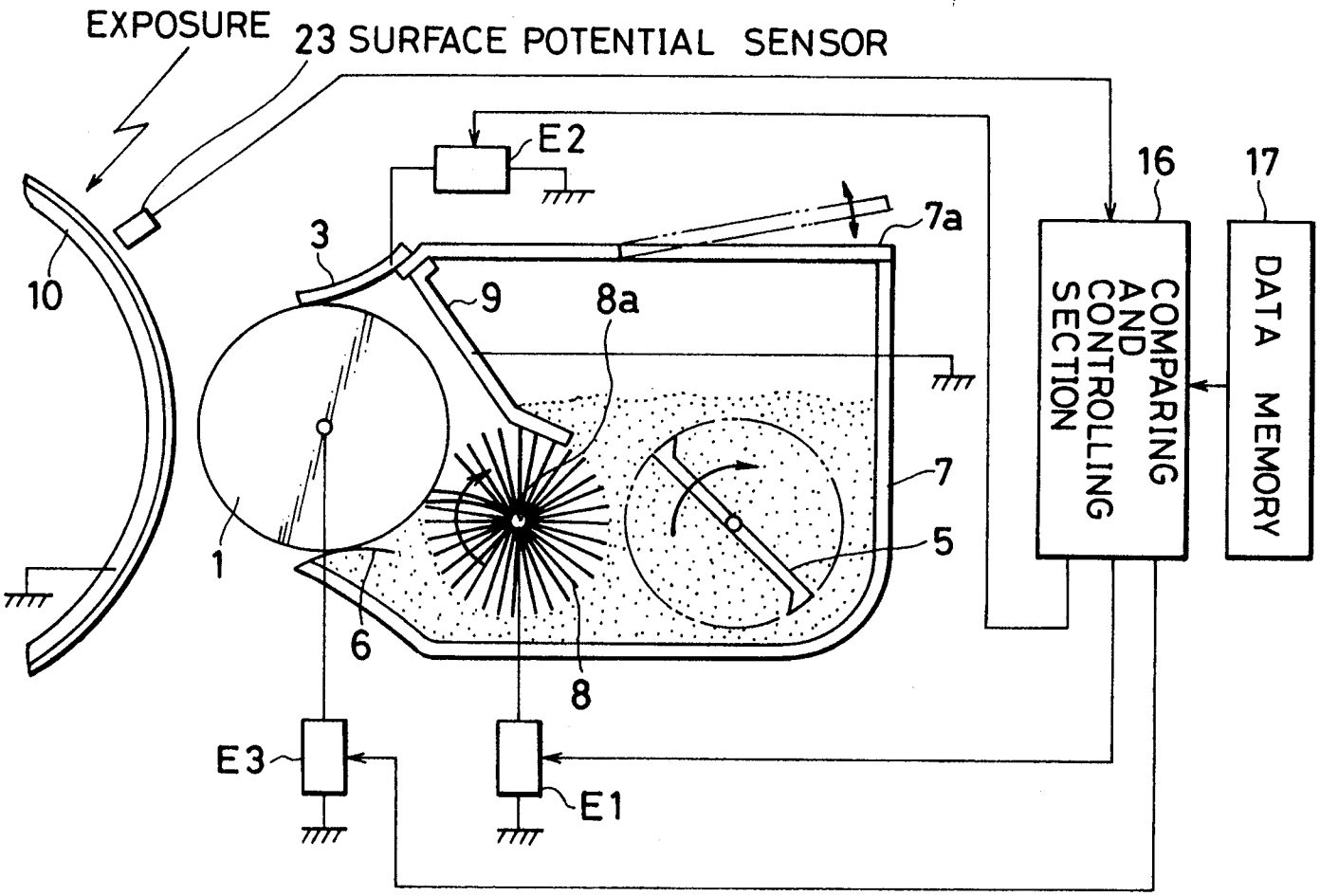
FIG. 4 is a block diagram showing a developing apparatus in a third embodiment of the present invention.
Figure 5:
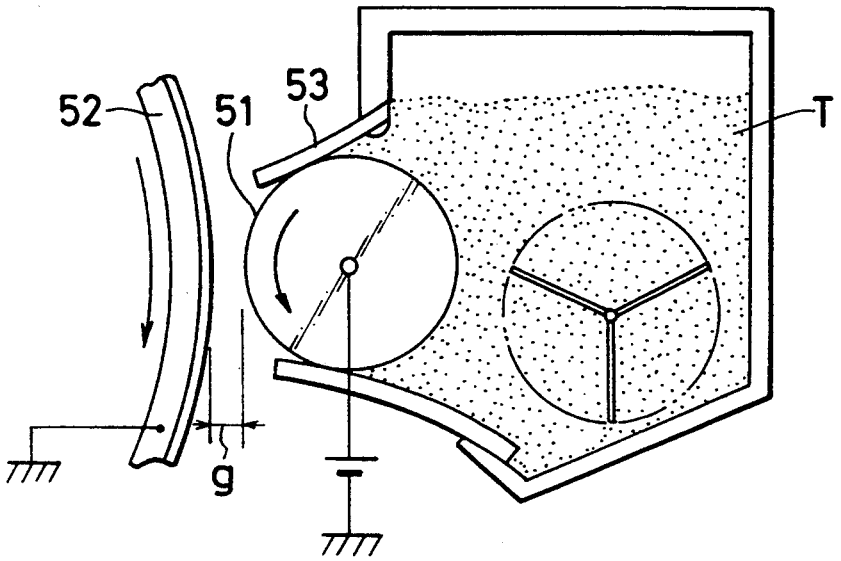
FIG. 5 is a sectional view illustrating an example of a conventional developing apparatus.

FIG. 4 is a block diagram showing a developing apparatus in a third embodiment of the present invention. The developing apparatus in this embodiment includes surface potential sensors 23, 24 which are arranged on the photosensitive medium 10 and the developer carrier medium 1, respectively, instead of the temperature sensor 21 and the humidity sensor 22 which are explained in the developing apparatus in the second embodiment shown in FIG. 3. The photosensitive medium 10, even though being uniformly charged, its charge function changes, depending upon its surrounding circumstance, using conditions and the like, and is also affected sometimes by deterioration in use of its charge section 11 itself, accordingly, it is not always applied with a uniform electric charge. Further, even in the case of forming an electrostatic latent image by a reference exposure energy thereafter, the sensitivity of the photosensitive medium varies depending upon its surrounding circumstance, using conditions or the like, and accordingly, the potential level of the electrostatic latent image is likely to vary. In order to stably develop the electrostatic latent image, coping with the potential level of the electrostatic latent image which readily varies, it is necessary to change the developing function of the developing apparatus in accordance with the potential level of the electrostatic latent image. Incidentally, an energy corresponding to one half of the exposure value of the photosensitive medium 10 is suitably used as the reference exposure energy for forming a reference electrostatic latent image in order to detect a surface potential on the photosensitive medium, but an energy to that extent can be also used with no substantial problem.

The surface potential sensor 23 is arranged near the photosensitive medium 10, being opposed to the circumferential position of the photosensitive medium 10 after exposure but before developing, and is connected at its output terminal to an input terminal of the comparing and controlling section 16. Also, the surface potential sensor 24 is arranged in the vicinity of the developer carrier medium 1 being opposed to the circumferential position of the developer carrier medium 1, and is connected at its output terminal to an input terminal of the comparing and controlling section 16.

As to the surface potential sensors 23, 24, a vibrating reed type, a sector type, a pyroelectric type or the like can be used, but the vibrating reed type is used in general, in which an electrostatic induced voltage from an object to be measured to a detecting electrode is periodically changed by a vibrator chopper driven by a piezoelectric ceramics, to be detected and taken out as an, a.c. voltage since an a.c. voltage can make subsequent amplification easier and can improve responsiveness. Further, in order to eliminate the dependency upon the distance between the object to be measured and the detecting electrode, a potential equal to the potential of the object to be measured is fed-back to a detecting probe so as to improve reliability.

It goes without saying that a drive circuit for driving the surface potential sensors 23, 24 should be incorporated although it is not specifically shown in FIG. 4. It may be incorporated either as a part of the comparing and controlling section or as an additional circuit connected to the latter.

Further, the comparing and controlling section 16 reads control data from a data memory 17 in accordance with outputs from the surface potential sensors 23, 24, and then controls the outputs of the power sources E1, E2, E3 in accordance with the control data. Further, in the developing apparatus in the third embodiment, a constant current power source is used as the power source E1, and constant voltage power sources are used as the power sources E2, E3, respectively.

Incidentally, other members which have not been explained in particular, are constructed similar to those in the developing apparatus in the second embodiment shown in FIG. 2, therefore the identical reference numerals are attached to members corresponding to those in the second embodiment, and accordingly, detailed explanation thereto is omitted.

The developing apparatus in the third embodiment constructed as above, carries out also an image density setting process prior to an image forming process, at the time of starting the operation of the image recording apparatus, similar to the developing apparatuses in the first and second embodiments. In more detail, the exposure section 11 exposes the photosensitive medium 10 which has been uniformly charged, to a light beam having a reference exposure energy, over a specified area thereof so as to form a reference electrostatic latent image. Further, in synchronization with the passing of the area where the reference electrostatic latent image has been formed, over a position opposed to the surface potential sensor 23, the latter detects a surface potential of the surface potential of the photosensitive medium 10. An output from the surface potential sensor 23 detecting the potential level of the reference electrostatic latent image is delivered to the comparing and controlling section 16 which then reads control data for the outputs of the mower sources E1, E2, E3, stored in the data memory 17, in accordance with the potential level of the reference electrostatic latent image, and which therefore controls the output current of the power source E1, and the output voltage of the power sources E2, E3.

The control of the power sources E1, E2, E3 in accordance with a variation in the potential level of the reference electrostatic latent image is made, for example, in such way that the output current of the power source E1 is decreased while the output voltages of the power sources E2, E3 are increased in the case of detecting a low potential. Further, in the case of detection of a high potential, the output current of the power source E1 is increased while the output voltage of the power source E2, E3 is decreased. Although it is possible to control by only the variation of the output voltage of the power source E3, the control by only the variation of the output voltage of the power source E3 is not preferable, similar to the developing apparatus in the first and second embodiments. However, control by combining outputs of the power sources E1, E2, E3 can ensure a stable developing function.

Similar to the developing apparatus in the first and second embodiments, in the developing apparatus of the third embodiment, the control of outputs of the power sources E1, E2, E3 in accordance with a variation in the potential level of the reference electrostatic latent image may be made not only before but also during the image forming process, that is, in the interspace between recording mediums.

Although the developing apparatus in the third embodiment is constituded to measure both a surface potential of the area of the photosensitive medium 10 over which the reference electrostatic latent image is formed, and a surface potential of the thin layer of the developer T formed over the developer carrier medium 1, it may also be constituded to measure at least one of the surface potentials.

Even in the developing apparatus in the third embodiment, the porous conductive resilient member 2 can be used as in the developing apparatus in the first embodiment shown in FIG. 1, instead of the fibrous conductive member 8. Also, detecting an empty condition of the developer, as explained in the description of the developing apparatus in the second embodiment and using a developer carrier medium 1 incorporating a semiconductor layer is possible.

Although in each of above embodiments it has been explained that the reverse-developing is carried out with the use of the positive-charge type developer T, the present invention should not be limited thereto, but the present invention can be similarly applied also in the case of using a negative charge type developer T, or to a normal developing process.

Further, although it has been explained that the individual control steps are made in accordance with factors relating to the developing function, such as density of developer, temperature, humidity, surface potential and the like in the above-mentioned embodiments, they may be combined and used as input data for the comparing and controlling section 16. In particular, in the control combining the humidity and the surface potential, it is possible to consider such a fact that the attenuation from the surface potential measuring section to the developing section differs, depending upon the temperature of the photosensitive medium 10. Thus, it is possible to perform fine and precise control. In the control combining density of the developer and temperature, combining the step to cope with variation in the characteristic of the photosensitive medium 10 with the stabilization of the density of the developer becomes possible, resulting in a stabler developing process.

As mentioned above, according to the present invention, there can be provided an arrangement having the functions of supply of a developer, charge, formation of a thin layer, conveyance to a developing section, control of flying force, removal, agitation and circulation which are important in the developing process using a non-magnetic one-component developer. In particular, by providing a developer carrier medium, an electrically conductive developer supply member and a conductivity regulating member which are connected respectively to controllable power sources, it is possible to eliminate instability in the developing conditions inherent in a conventional arrangement which heretofore neglects the frictional charge and the flow of developer, and to facilitate the setting of suitable developing conditions for satisfactory reproduction of an image (that is, various parameters can be set individually), thereby realizing stable development of an image so that an excellent effect can be exhibited in view of reliability.

Further, with the arrangement within the developing apparatus, when a foreign matter enters into the developer, although it could reach the vicinity of the upper part of the electrically conductive developer supply member, it can be prevented from being advanced to the next processing step, due to the fact that the developer is fed threafter by the electrically conductive developer supply member, being effective in enhancing reliability.

Further, in view of the circumstance characteristic, since frictional charge system which is greatly affected by the surrounding circumstance or the surface condition of a material is not used, there is an effect of exhibiting a stable characteristic.

Furthermore, the following effects can be also obtained: the density of developer can be controlled by controlling the voltages applied to the developer carrier medium, the electrically conductive developer supply member and the conductivity regulating member, and the level of the density of an image can be adjusted by controlling the applied voltages even though variations in the circumstance, variations of the developer, variations in the electric resistances of these component members, unevenness of lots, or the like would occur.

What is claimed is:

1. A developing apparatus comprising:

a developer carrier medium for carrying thereon a developer for developing a latent image formed on a latent image carrier medium;

an electrically conductive developer supply member rotatably arranged while making contact with said developer carrier medium;

a conductivity regulating member for regulating a layer thickness of the developer onto said developer carrier medium so as to form a thin layer of the developer on said developer carrier medium, and for applying a predetermined degree of electric charge to the developer;

separate power sources for supplying predetermined outputs to said developer carrier medium, said electrically conductive supply member and said conductivity regulating member, respectively; and control means for independently controlling the outputs of each of said power sources in accordance with an output from a means for detecting a factor relating to a developing function of said developing apparatus.

2. A developing apparatus as set forth in claim 1, wherein said means for detecting a factor relating to the developing function is adapted to detect a density of the developer on said latent image carrier medium.

3. A developing apparatus as set forth in claim 1, wherein said means for detecting a factor relating to the developing function is adapted to detect at least either one of temperature and humidity in the vicinity of said latent image carrier medium.

4. A developing apparatus as set forth in claim 1, wherein said means for detecting a factor relating to the developing function is adapted to detect a surface potential of at least one of said latent carrier medium and said developer carrier medium.

5. A developing apparatus as set forth in claim 4, wherein said means for detecting a factor relating to developing function is adapted to detect a surface potential of an area where a reference latent image is formed on said latent image carrier medium, and a surface potential of the thin layer of the developer which is formed on said developer carrier medium.

6. A developing apparatus as set forth in claim 1, wherein said means for detecting a factor relating to the developing function is adapted to detect any composite and mutual combination of density of the developer on said latent image carrier medium, temperature and humidity in the vicinity of said latent image carrier medium, and surface potentials of said latent image carrier medium and said developer carrier medium.

7. A developer apparatus as set forth in claim 6, wherein said composite combination is a combination of the temperature in the vicinity of said latent image carrier medium and surface potential of said developer carrier medium.

8. A developing apparatus as set forth in claim 1, wherein said power sources are d.c. voltage sources for applying constant voltages to said developer carrier medium, said electrically conductive developer supply member and said conductivity regulating member.

9. A developing apparatus as see forth in claim 1, wherein said power sources are composite d.c. and a.c. constant voltage power sources.

10. A developing apparatus as set forth in claim 1, wherein said power sources are a constant voltage power source for applying a voltage to said developer carrier medium, and constant current power sources for applying currents to said electrically conductive developer supply member and said conductivity regulating member, respectively.

* * * * *